US007710041B2

(12) United States Patent
Miyake

(10) Patent No.: US 7,710,041 B2
(45) Date of Patent: May 4, 2010

(54) MICROWAVE TUBE

(75) Inventor: Setsuo Miyake, Nasushiobara (JP)

(73) Assignees: Kabushiki Kaisha Toshiba, Tokyo (JP); Toshiba Electron Tubes & Devices, Co., Ltd., Mochigi-Ken (JP)

( * ) Notice: Subject to any disclaimer, the term of this patent is extended or adjusted under 35 U.S.C. 154(b) by 545 days.

(21) Appl. No.: 11/711,037

(22) Filed: Feb. 27, 2007

(65) Prior Publication Data

US 2007/0200506 A1 Aug. 30, 2007

(30) Foreign Application Priority Data

Feb. 28, 2006 (JP) ..... 2006-053322

(51) Int. Cl.
*H01J 25/00* (2006.01)

(52) U.S. Cl. ..... 315/39; 315/5.41; 315/5.35

(58) Field of Classification Search ..... 315/5.35, 315/5.34, 5.52, 5.27, 39, 3.5, 4, 5.41, 500–505; 330/49, 44, 43, 45
See application file for complete search history.

(56) References Cited

U.S. PATENT DOCUMENTS 3,309,558 A * 3/1967 Heil ..... 315/5.39
6,259,207 B1 7/2001 Kirshner
6,486,605 B1 * 11/2002 Beunas et al. ..... 315/5.35
6,617,791 B2 * 9/2003 Symons ..... 315/5.35
6,768,266 B2 * 7/2004 Faillon et al. ..... 315/5.39
6,847,168 B1 * 1/2005 Ives et al. ..... 315/5.35
7,145,297 B2 * 12/2006 Bohlen et al. ..... 315/5.39
2005/0116651 A1 * 6/2005 Heppinstall et al. ..... 315/5.39

FOREIGN PATENT DOCUMENTS

GB 961998 5/1961
JP 11-149876 6/1999
JP 2001-15043 1/2001

OTHER PUBLICATIONS

European Search Report dated Jan. 22, 2009 for Appln. No. 071031181.1-2208.

* cited by examiner

*Primary Examiner*—Douglas W Owens
*Assistant Examiner*—Ephrem Alemu
(74) *Attorney, Agent, or Firm*—Pillsbury Winthrop Shaw Pittman, LLP

(57) ABSTRACT

An output power adjusting mechanisms for adjusting output power is provided on a wave guide of a high frequency output section coupled to an output cavity. The output power adjusting mechanisms is located at a position apart away from the output cavity by a distance of ⅛ wavelength or [(⅛ wavelength)×odd number]. The output power adjusting mechanism includes a reflection adjusting part which is provided in the tube wall of the wave guide so as to be displaceable in the inward and outward directions of the output tube. The output power is adjusted by displacing the reflection adjusting part.

4 Claims, 3 Drawing Sheets

MICROWAVE TUBE

CROSS-REFERENCE TO RELATED APPLICATIONS

This application is based upon and claims the benefit of priority from prior Japanese Patent Application No. 2006-053322, filed Feb. 28, 2006, the entire contents of which are incorporated herein by reference.

BACKGROUND OF THE INVENTION

1. Field of the Invention

The present invention relates to a microwave tube having a high frequency output section coupled to an output cavity.

2. Description of the Related Art

A large power klystron has been known as a microwave tube using the linear beam. The klystron is composed of: a klystron body including an electron gun for generating an electron beam, an input section for inputting high frequency power, a high frequency interacting section for amplifying high frequency power through the interaction of the electron beam with a high frequency electric field, a high frequency output section with a high frequency window for outputting the high frequency power that is amplified by the high frequency interacting section, and a collector section for collecting the electron beam that is no longer needed; and a magnetic field focusing device, mounted to and around the klystron body, for reducing the diameter of the electron beam to be a given diameter (Jpn. Pat. Appln. KOKAI Publication No. 11-149876, pages 2 to 3, FIGS. 1 and 2).

In some of this type of klystron, a plurality of high frequency output sections are coupled to the output cavity in order to cope with the power withstanding of the high frequency window or to meet client's requests.

If the coupling parts to the output cavity, the high frequency windows and the like, which are provided for one of those, for example, two high frequency output sections, are electrically and exactly the same as those for the other high frequency output section, the high frequency power output from one high frequency output section is exactly equal to that output from the other one. However, those high frequency output powers are minutely different from each other because of variations of the mechanical dimension of the coupling part to the output cavity and the high frequency window, variation of the relative permittivity of the dielectric member attached as the air-tight member to the high frequency window, and deformation of the wave guide. In the case where the matching of those high frequency output powers from the two high frequency output sections is lost, returning high frequency waves occur. This results in highering of VSWR (voltage standing wave ratio).

The difference between those two output powers is within 5% when the VSWR is low, in which case no problem arises. When the output power difference becomes a problem, a high frequency power mixer/divider 1 as shown in FIG. 7 is used. Generally, in the power mixer/divider 1, the high frequency powers output through two high frequency windows 2 are changed in traveling directions at corners 3, are mixed by a magic tee 4, and the mixed power is divided again into two high frequency powers at another magic tee 4, and those high frequency powers are changed in traveling directions at corners 5, and finally output to outside.

When the power mixer/divider 1 is used for the klystron, however, the external dimension of the klystron becomes large. Even when the power mixer/divider 1 is used, the two output powers could be exactly equal to each other if the electrical symmetry is secured. Actually, however, an output power difference inevitably occurs since the dimension accuracy variation of the magic tees 4 and other parts at the manufacturing stage is present.

BRIEF SUMMARY OF THE INVENTION

Accordingly, an object of the present invention is to provide a microwave tube in which the high frequency powers output from the high frequency output sections can be easily adjusted.

According to the present invention, there is provided a microwave tube having a high frequency output section coupled to an output cavity, wherein the high frequency output section includes: an output tube connected to the output cavity; and an output power adjusting mechanism which has a reflection adjusting part provided in the tube wall of the output tube so as to be displaceable in the inward and outward directions of the output tube, and which adjusts the output power by displacing the reflection adjusting part.

In the microwave tube constructed according to the present invention, the output powers of high frequency output from the high frequency output sections can be easily adjusted in a manner that a reflection adjusting part, which is provided in the tube wall of an output tube, is displaced in the inward or outward direction of the output tube by an output power adjusting mechanism. Therefore, when a plurality of high frequency output sections are used, the output powers of the high frequency output sections are easily adjusted for matching therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described with reference to the accompanying drawings.

FIGS. 1 to 4 show a first embodiment of the invention.

Figure 4:
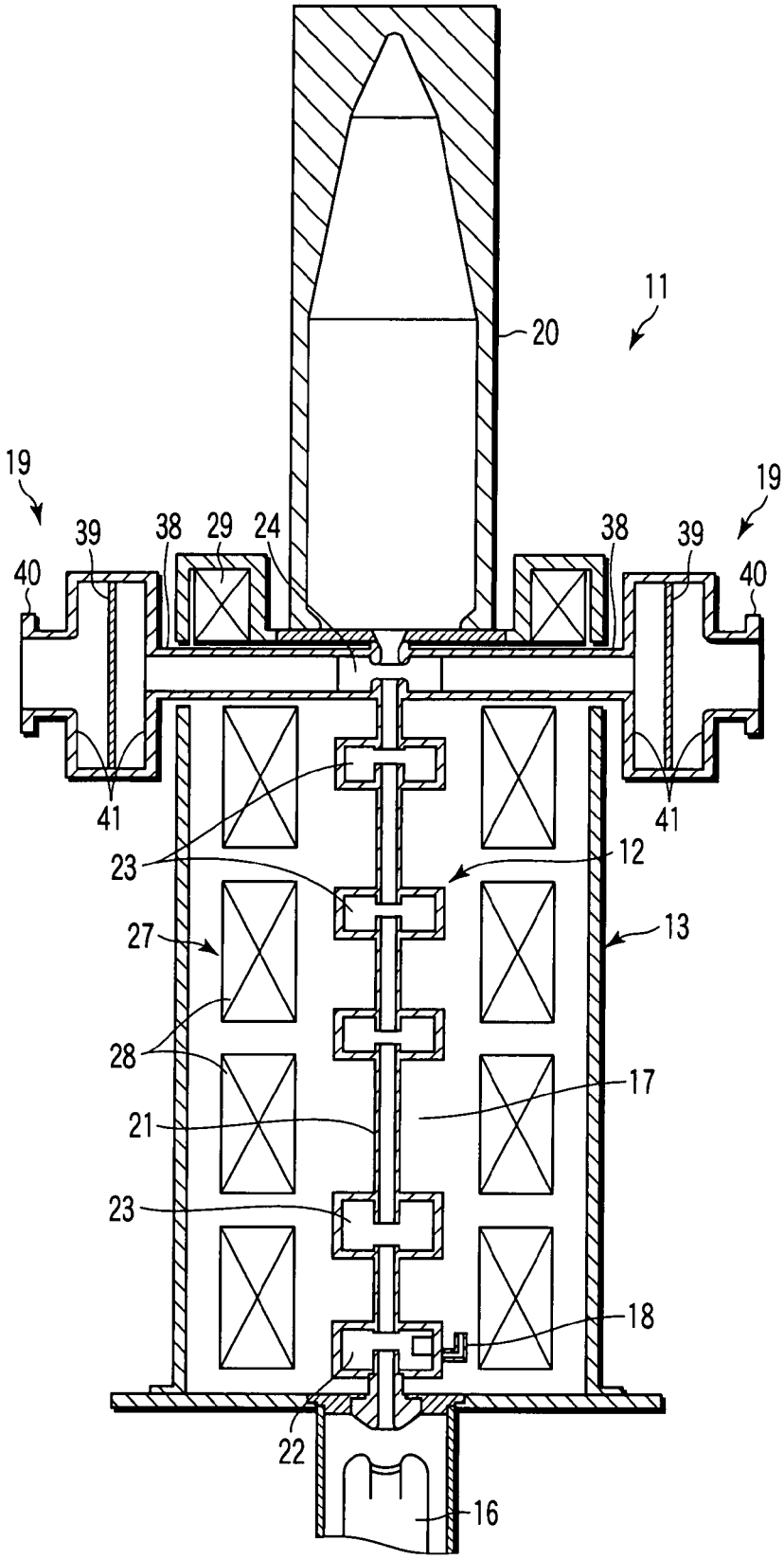
FIG. 4 is a cross sectional view showing the klystron.

As shown in FIG. 4, a klystron 11 as a microwave tube is composed of a klystron body 12 and a focusing magnetic field device 13.

The klystron body 12 includes an electron gun 16 for producing an electron beam, a high frequency interacting section 17 for amplifying high frequency power through the interaction of the electron beam with a high frequency electric field, an input section 18 for inputting high frequency power to the high frequency interacting section 17, a plurality of, for example, two high frequency output sections 19 for outputting the high frequency power that is amplified by the high frequency interacting section 17, and a collector section 20 for collecting the electron beam that has passed through the high frequency interacting section 17 and is no longer needed.

The high frequency interacting section 17 includes a drift tube 21 through which the electron beam passes, an input cavity 22 coupled to the input section 18, a plurality of intermediate cavities 23, and an output cavity 24 coupled to the two high frequency output sections 19.

The focusing magnetic field device 13 includes a main magnetic field generator 27 disposed around the high frequency interacting section 17, and sometimes further includes an electron-gun side magnetic field generator (not shown) disposed around the electron gun 16 at one end of the main magnetic field generator 27. The main magnetic field generator 27 includes main coils 28 disposed around the high frequency interacting section 17, and an output coil 29 located on the outer side than the output cavity 24.

Figure 1:
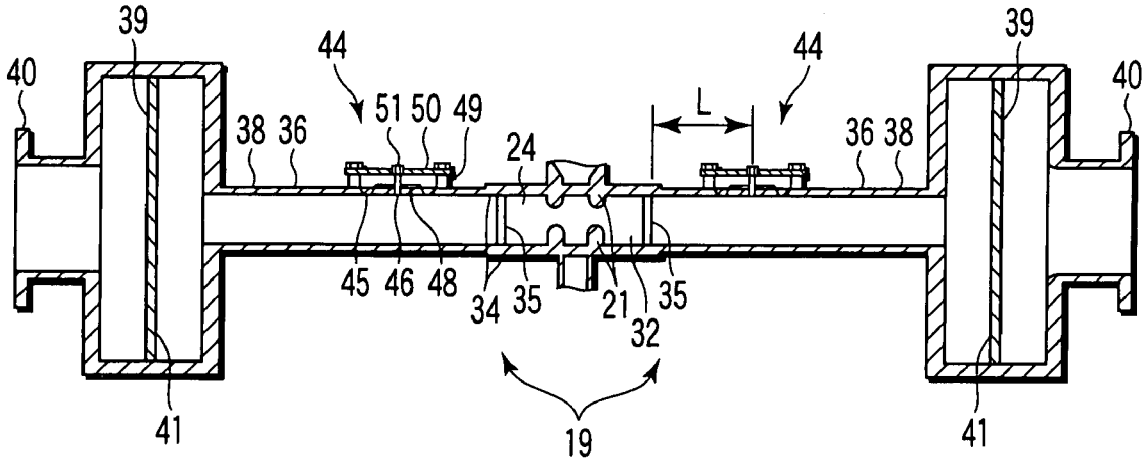
FIG. 1 is a cross sectional view showing an output cavity and high frequency output sections of a klystron, which is a first embodiment of the invention.
Figure 2:
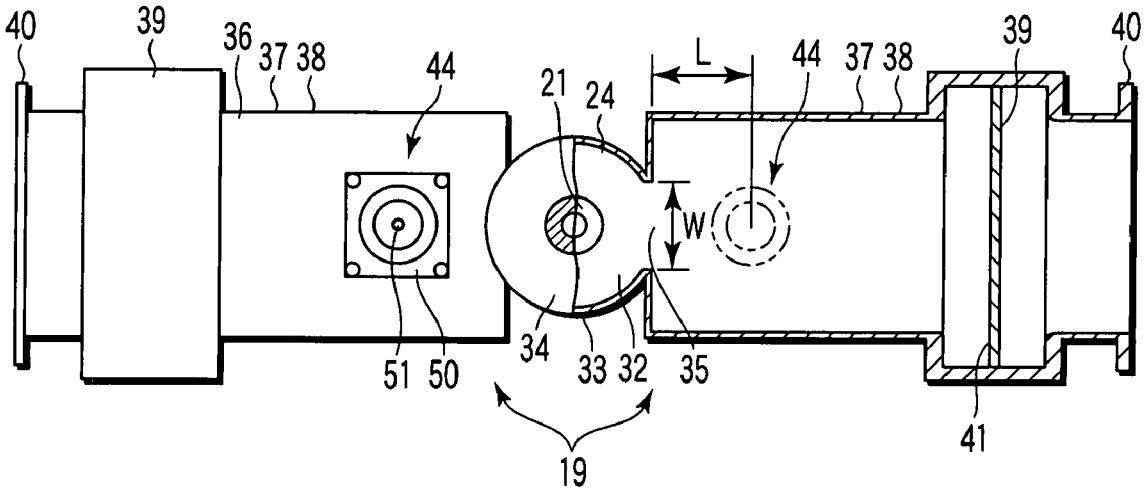
FIG. 2 is a plan view showing the output cavity and the high frequency output sections of the klystron.
Figure 3:
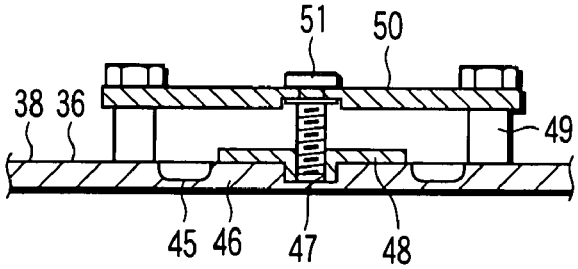
FIG. 3 is an enlarged cross sectional view showing an output power adjusting mechanisms of the klystron.

FIG. 1 is a cross sectional view showing the output cavity 24 and the high frequency output sections 19 of the klystron 11. FIG. 2 is a plan view showing the output cavity 24 and the high frequency output sections 19 of the klystron 11.

An cavity resonator 32 forming the output cavity 24 is provided with cylindrical cavity walls 33 and upper and lower faces 34. The cavity walls 33 and the upper and lower faces 34 are made of good conductive metal, for example, copper. The drift tube 21 extends to the center axis part of the output cavity 24 through which the electron beam passes, through the upper and lower faces, to thereby form a semi-coaxial cavity resonator.

Formed in the side walls of the cavity resonator 32 are two opened rectangular windows each having a long side W extending in the peripheral direction. Those windows are called irises 35 through which the high frequency output sections 19 are coupled with each other.

Each high frequency output section 19 takes a rectangular shape having long sides 36 and short sides 37, in conformity with the rectangular shape of each iris 35. Each high frequency output section 19 includes a wave guide 38 as an output tube which is rectangular in cross section and coupled with the cavity resonator 32. The wave guide 38 is provided with a high frequency window 39 and an output flange 40 located on the outer side than the high frequency window. A disc-like dielectric member 41 made of, for example, ceramic, which is for ensuring vacuum tightness, is placed within the high frequency window 39.

An output power adjusting mechanism 44 is provided at a position of the wave guide 38 of each high frequency output section 19, which is located at the central part of one of the long sides 36 of the wave guide 38 and is apart away from the cavity resonator 32 by a distance L. The output power adjusting mechanism 44 adjusts an output power by locally displacing the tube wall of the wave guide 38 in inward and outward directions of the wave guide. The distance L measured from the cavity resonator 32 is equal to ⅛ wavelength (λ) electrical length or distance of [(⅛λ)×odd number], measured from the cavity resonator 32.

In the output power adjusting mechanism 44, an annular thin part 45 is formed in the wall of the wave guide 38. A circular reflection adjusting part 46 is formed on the inner side of the annular thin part 45, and is displaceable in the inward and outward of the wave guide with the aid of the annular thin part 45. An adjusting plate 48 having a screw hole 47 at the center is fastened to the outer surface of the reflection adjusting part 46.

A plurality of supports 49 are protruded from the outer surface of the wave guide 38, while surrounding the reflection adjusting part 46. A support plate 50 is firmly mounted on the tips of those supports 49. An adjusting screw 51 is rotatably inserted into the support plate 50, and the tip of the adjusting screw 51 is screwed into the screw hole 47 of the adjusting plate 48.

When the adjusting screw 51 is turned in one or the other direction, the reflection adjusting part 46 on the inner side of the annular thin part 45, together with the adjusting plate 48, is displaced in the inward or the outward direction of the wave guide with respect to the wave guide 38 and the support plate 50 to thereby adjust the high frequency reflection within the wave guide 38. The high frequency reflection is capacitive and inductive, and an imaginary part reflection. Since the reflection adjusting part 46 is apart away from the cavity resonator 32 by the ⅛λ distance, the reflection is a real part reflection when viewed from the cavity resonator 32 distanced backward by the ⅛λ length. Accordingly, the load impedance when viewed from the cavity resonator 32 is adjusted by varying the coupling quantity to the load. When the reflection adjusting part 46 is displaced in the inward direction of the wave guide to decrease the diameter of the wave guide 38, the high frequency reflection is capacitive. When it is displaced in the outward direction to increase the diameter of the wave guide 38, the reflection is inductive. Accordingly, when the reflection adjusting part 46 is displaced inward to decrease the diameter of the wave guide 38, the capacitive component increases, and when viewed from the cavity resonator 32 distanced backward by the ⅛λ length, the load impedance increases and the output power becomes low. Conversely, when it is displaced outward to increase the diameter of the wave guide 38, the negative capacitance component, i.e., the inductive component, becomes large and the output power becomes high.

In the structure where the two high frequency output sections 19 are coupled to the cavity resonator 32, the respective load impedances can be adjusted by using the output power adjusting mechanisms 44. Accordingly, the output power to the output flanges 40 coupled to the wave guides 38 may be adjusted as desired.

The irises 35 provided in the cavity resonator 32 may become capacitive and inductive, and the electric field expands from the cavity resonator 32 into the wave guide 38 through the irises 35. For this reason, the distance L from the end face of the wave guide 38 to the center of each output power adjusting mechanism 44 is not simply determined to be the ⅛λ length wave guide. However, the output power is most effectively adjusted when the distance L is electrically selected to be the ⅛λ length.

In the case where the distance L is selected to be [(⅛λ)× odd number], it is replaced with [⅛+(¼×n)]. In the expression, if n=even number, the reflection adjustment acts in the same direction as in the case of ⅛λ length. If n=odd number, the adjustment acts in the opposite direction as in the case of ⅛λ length.

Thus, the high frequency output power output from each high frequency output section 19 is easily adjusted in a manner that the reflection adjusting part 46 provided in the tube wall of the wave guide 38 is displaced in the inward or outward direction of the wave guide by means of the output power adjusting mechanisms 44.

For this reason, in the case where a plurality of high frequency output sections 19 are used, it is possible to adjust the output powers of the high frequency output sections 19 for matching therebetween. In other words, the output powers that are minutely different from each other can be adjusted to be equal to each other without using the power mixer/divider.

The output power adjusting mechanisms 44 may be provided on both the long sides 36 of the wave guide 38, one or both short sides 37 of the wave guide 38, or the long side 36 and/or the short side 37 of the wave guide 38. In the case where the output power adjusting mechanisms 44 is provided on the short side 37 of the wave guide 38, the inductive component is adjusted through the inward displacement.

The annular thin part 45 and the reflection adjusting part 46 of the output power adjusting mechanisms 44 are annular and circular, but may be elliptical, square or the like.

Figure 5:
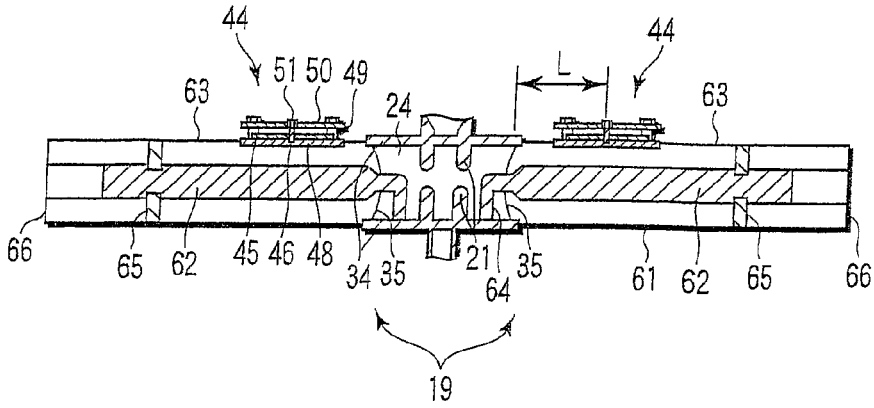
FIG. 5 is a cross sectional view showing an output cavity and high frequency output sections of a klystron, which is a second embodiment of the invention.
Figure 6:
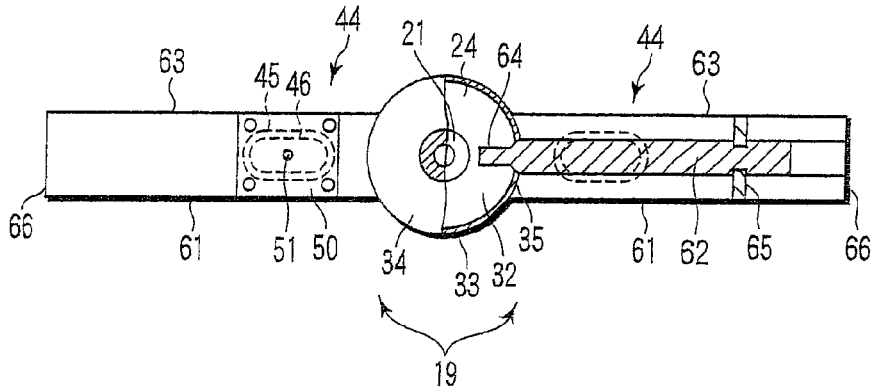
FIG. 6 is a plan view showing the output cavity and the high frequency output sections of the klystron.
Figure 7:
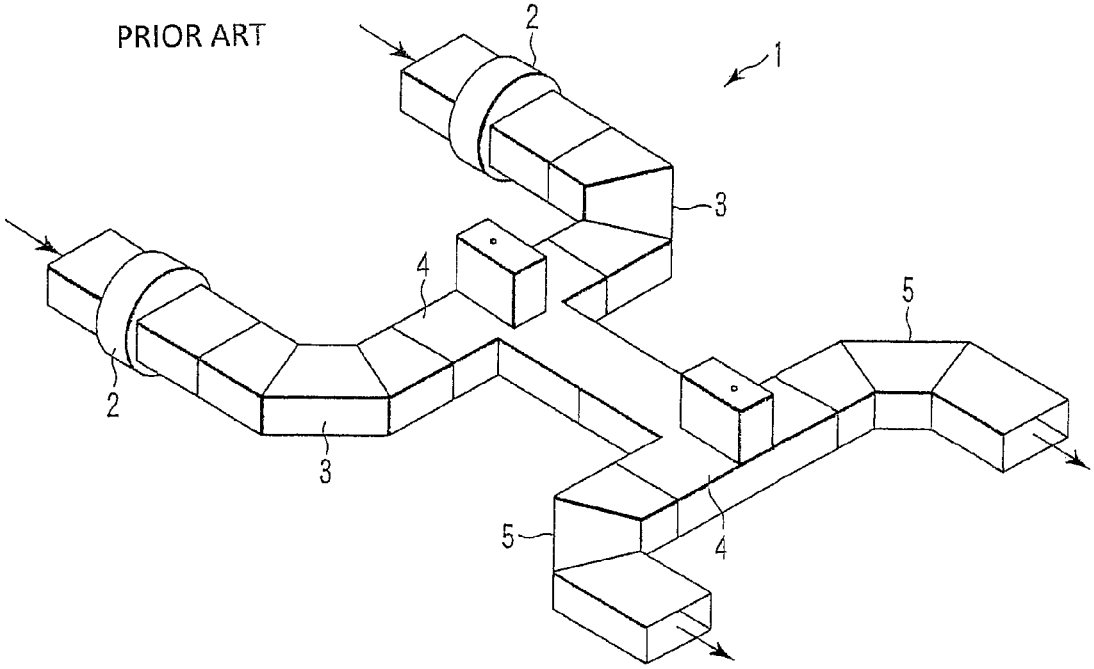
FIG. 7 is a perspective view showing a power mixer/divider used for a conventional klystron.

A second embodiment of the present invention will be described with reference to FIGS. 5 and 6.

The two high frequency output sections 19 include coaxial tubes 63 as output tubes, each having an outer tube 61 and an inner tube 62. The outer tube 61 of each coaxial tube 63 is coupled to the cavity walls 33 of the cavity resonator 32. The inner tube 62 is connected to a coupling loop 64 located in the cavity resonator 32. A vacuum tightness of each coaxial tube 63 is secured by a disc-like dielectric member 65 which is made of ceramic, for example, and has a hole allowing the inner tube 62 to pass therethrough.

Each coaxial tube 63 is provided with the output power adjusting mechanisms 44, which is located at a position apart away from the cavity resonator 32 by an electrical distance of ⅛λ or (⅛λ×odd number). In each output power adjusting mechanism 44, an annular thin part 45, elongated in the axial direction of the coaxial tubes 63, is formed in the tube wall of the outer tube 61 of the coaxial tubes 63. An elliptical reflection adjusting part 46 is formed on the inner side of the elongated annular thin part 45, and is displaceable in the inward and outward of the coaxial tube with the aid of the annular thin part 45. An adjusting plate 48 having a screw hole 47 at the center is fastened to the outer surface of the reflection adjusting part 46.

A plurality of supports 49 are protruded from the outer surface of the outer tube 61 of the coaxial tubes 63, while surrounding the reflection adjusting part 46. A support plate 50 is firmly mounted on the tips of those supports 49. An adjusting screw 51 is rotatably inserted into the support plate 50, and the tip of the adjusting screw 51 is screwed into the screw hole 47 of the adjusting plate 48.

When the adjusting screw 51 is turned in one or the other direction, the reflection adjusting part 46 on the inner side of the annular thin part 45, together with the adjusting plate 48, is displaced in the inward or the outward direction of the wave guide with respect to the coaxial tubes 63 and the support plate 50 to thereby adjust the high frequency reflection within the coaxial tubes 63.

This reflection is an imaginary part reflection, and is a real part reflection when viewed from the cavity resonator 32 distanced backward by the ⅛λ length. Accordingly, the load impedance when viewed from the cavity resonator 32 can be adjusted, and the output power to output terminals 66 connected to the two coaxial tubes 63 can be adjusted.

Each embodiment mentioned above may be modified as follows. A part of the tube wall of the wave guide 38 or the coaxial tube 63 is formed separately from the latter, and hermetically fastened to the latter. The annular thin part 45 and the reflection adjusting part 46 of the output power adjusting mechanism 44 are incorporated into the separate portion.

The microwave tube is not limited to the klystron 11, but may be a linear accelerator, a traveling-wave tube or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A microwave tube, comprising:

a high frequency output section coupled to an output cavity, wherein the high frequency output section includes:

an output tube connected to the output cavity; and a pair of output power adjusting mechanisms provided with the output cavity interposed therebetween, each of the output power adjusting mechanisms having a reflection adjusting part provided in the tube wall of the output tube so as to be displaceable in the inward and outward directions of the output tube, and which adjusts the output power by displacing the reflection adjusting part.

2. The microwave tube according to claim 1, wherein a plurality of high frequency output sections are provided, each of which is coupled to the output cavity.

3. The microwave tube according to claim 1, wherein the output power adjusting mechanism is apart away from the output cavity by a distance of ⅛ wavelength or [(⅛ wavelength)×odd number].

4. The microwave tube according to claim 1, wherein the output tube takes a rectangular shape defined by long and short sides, and the output power adjusting mechanism is either provided on the long side of the rectangular shape of the output tube for capacitive adjustment, or provided on the short side for inductive adjustment.

* * * * *